US009592595B2

(12) United States Patent
Conway

(10) Patent No.: US 9,592,595 B2
(45) Date of Patent: Mar. 14, 2017

(54) TOOL HAVING AUTOMATED CONTINUOUS FEEDING METHOD FOR APPLYING HOG RINGS

(71) Applicant: L&P Property Management Company, South Gate, CA (US)

(72) Inventor: Lawrence J. Conway, Des Plaines, IL (US)

(73) Assignee: L&P Property Management Company, South Gate, CA (US)

( * ) Notice: Subject to any disclaimer, the term of this patent is extended or adjusted under 35 U.S.C. 154(b) by 331 days.

(21) Appl. No.: 14/200,200

(22) Filed: Mar. 7, 2014

(65) Prior Publication Data

US 2014/0331488 A1 Nov. 13, 2014

Related U.S. Application Data

(60) Provisional application No. 61/821,785, filed on May 10, 2013.

(51) Int. Cl.
*B25B 27/14* (2006.01)

(52) U.S. Cl.
CPC ..... *B25B 27/146* (2013.01); *Y10T 29/53513* (2015.01)

(58) Field of Classification Search
CPC ... B25B 27/146; B25B 3/00; Y10T 29/53513; Y10T 29/53783; Y10T 29/53478; B65B 51/04; B23P 19/04; B23Q 7/06
See application file for complete search history.

(56) References Cited

U.S. PATENT DOCUMENTS

| | | | | |
|---|---|---|---|---|
| 3,013,270 | A | 12/1961 | Chilton | |
| 3,628,230 | A | 12/1971 | Grise | |
| 3,830,089 | A | 8/1974 | Boyd et al. | |
| 5,123,273 | A * | 6/1992 | Kawabata | B25B 27/146 221/312 A |
| 5,653,140 | A | 8/1997 | West | |
| 5,709,124 | A * | 1/1998 | Murayama | B25B 27/146 227/120 |
| 8,136,381 | B2 | 3/2012 | Murayama | |

* cited by examiner

*Primary Examiner* — Jason L Vaughan
(74) *Attorney, Agent, or Firm* — Wood, Herron & Evans, LLP

(57) ABSTRACT

A tool for securing items together closes C-rings to create hog rings. A drive mechanism allows the tool be used continuously for a greater length of time than heretofore possible without inserting a new string of C-rings. The drive mechanism utilizes one-way clutch bearings to provide a ratchet-like mechanism. Each time a trigger on the tool is pulled, a C-ring is closed and another C-ring is advanced to a position in which it may be closed by the same jaws. A pneumatic system moves a piston inside a cylinder to move the C-rings along a magazine towards the jaws.

20 Claims, 19 Drawing Sheets

TOOL HAVING AUTOMATED CONTINUOUS FEEDING METHOD FOR APPLYING HOG RINGS

CROSS-REFERENCE TO RELATED APPLICATIONS

This application claims the benefit of U.S. Provisional Patent Application Ser. No. 61/821,785 filed May 10, 2013, which is fully incorporated by reference herein.

FIELD OF THE INVENTION

This invention relates generally to pneumatically activated tools for applying hog rings around two items to secure the items together.

BACKGROUND OF THE INVENTION

C-rings usually come in strands of a predetermined number of C-rings bound together with tape. In most tools used to form hog rings from the C-rings, these strands of C-rings are depleted in a hurry, sometimes in a matter of minutes. Using such an applicator tool, the tool operator must stop using the tool and reload the tool with a new strand. It may be necessary to reset the feed system of the tool every time a new strand of C-rings is inserted into the tool. This procedure wastes valuable time and money.

U.S. Pat. No. 5,709,124 discloses a hog ring clamping device having pneumatic means for activating jaws to close a C-ring. One disadvantage with the tool disclosed in this patent is that it requires many moving parts which may break or malfunction. It is also difficult to load C-rings into the tool disclosed in this patent.

One advantage of the tool of the present invention is that it is easier and faster to load C-rings into the present tool than the tool disclosed in U.S. Pat. No. 5,709,124. In addition, the present tool has fewer moving parts, thereby reducing the possibility of the tool malfunctioning or becoming inoperable.

SUMMARY OF THE INVENTION

The present invention is directed to a clamping tool for closing C-rings to create hog rings around items, such as wires, to be secured together.

According to one aspect of the invention, the clamping tool comprises a body comprising a handle and a pneumatic cylinder. The clamping tool further comprises a piston movable inside the cylinder, the piston being attached to a piston rod extending from the piston towards a front end of the tool. A movable trigger activates the piston inside the pneumatic cylinder and moves the piston rod. The clamping tool further comprises a pair of side plates secured to the body, the piston rod being movable between the side plates. A pusher is attached to the piston rod for engaging and moving a clamp, the clamp being fixedly secured to a shaft. The shaft is secured in position by a mounting bracket secured to one of the side plates. Two movable jaws are pivotally mounted to the side plates. At least one feed roller and at least one one-way clutch bearing surround the shaft, the shaft extending through each of the feed rollers and each of the one-way clutch bearings. A spring biases the clamp rearwardly towards the body of the tool. A magazine is attached to one of the mounting plates, the magazine being adapted to receive a plurality of C-rings.

In operation, upon the trigger being pulled, the piston moves rearwardly with the piston rod. Rollers located at the end of the piston rod contact the jaws and cause the front of the jaws to close around a C-ring, creating a hog ring. The hog ring may be used to join two or more items together or other uses such as closing bags, for example. Rearward movement of a pusher attached to the piston rod enables the spring to exert its force upon the clamp. Because the clamp is connected to the shaft, the shaft and clamp pivot or rotate in a counter-clockwise direction when viewed from the top of the tool. Due to the one-way bearings being able to rotate only in the counter-clockwise direction, when viewed from the top of the tool, the feed rollers pivot or rotate in a counter-clockwise direction, when viewed from the top of the tool, with the clamp, shaft and one-way bearings to advance the C-rings one at a time into a clamping position from the magazine.

Upon an operator pulling the trigger, the piston, piston rod and pusher attached to the piston rod move backwardly due to air flow in and out of the cylinder. The release of the contact between the pusher and the clamp allows the loaded or energized spring that is also in contact with the clamp and biases the clamp, to move or rotate the clamp and shaft in a counter-clockwise direction, as viewed from the top of the tool, along with the bearings and feed rollers. The counter-clockwise rotation, or pivoting of the feed rollers in contact with the C-rings, advance the C-rings, one at a time, into a clamping position from the magazine.

Upon release of the trigger, the piston, piston rod and pusher attached to the piston rod move forwardly toward the clamp due to air flow in and out of the cylinder. The pusher attached to the piston rod moves forwardly toward the clamp. The pusher makes contact with the clamp that is attached to the shaft and rotates it in a clockwise direction, when viewed from the top of the tool. With this clockwise rotation of the clamp, the loaded or energized spring that is in contact with the clamp increases its load of spring compression. Due to the one-way clutch bearings not being able to rotate in a clockwise direction, when viewed from the top of the tool, upon release of the trigger, only the clamp and shaft rotate in the clockwise direction while the feed rollers remain stationary. The clockwise movement or pivoting of the clamp causes the spring to further load so that upon the next pull of the trigger, the spring may cause the clamp, shaft and feed rollers to rotate in a counter-clockwise direction, as viewed from the top of the tool, and described above.

The clamping tool of the invention provides a hand-held tool which enables more C-rings to be loaded into the tool than heretofore known hand-held clamping tools. The ability to continue applying C-rings around items to be secured together without reloading the tool with C-rings saves time and money. The operator may continue working for greater lengths of time without having to reload the tool with C-rings. These and other advantages of the present invention will more readily become apparent from the description of the drawings herein, in which:

BRIEF DESCRIPTION OF THE DRAWINGS

The objectives and features of the present invention will become more readily apparent when the following detailed description of the drawings is taken in conjunction with the accompanying drawings in which.

DETAILED DESCRIPTION OF THE DRAWINGS

Figure 1:
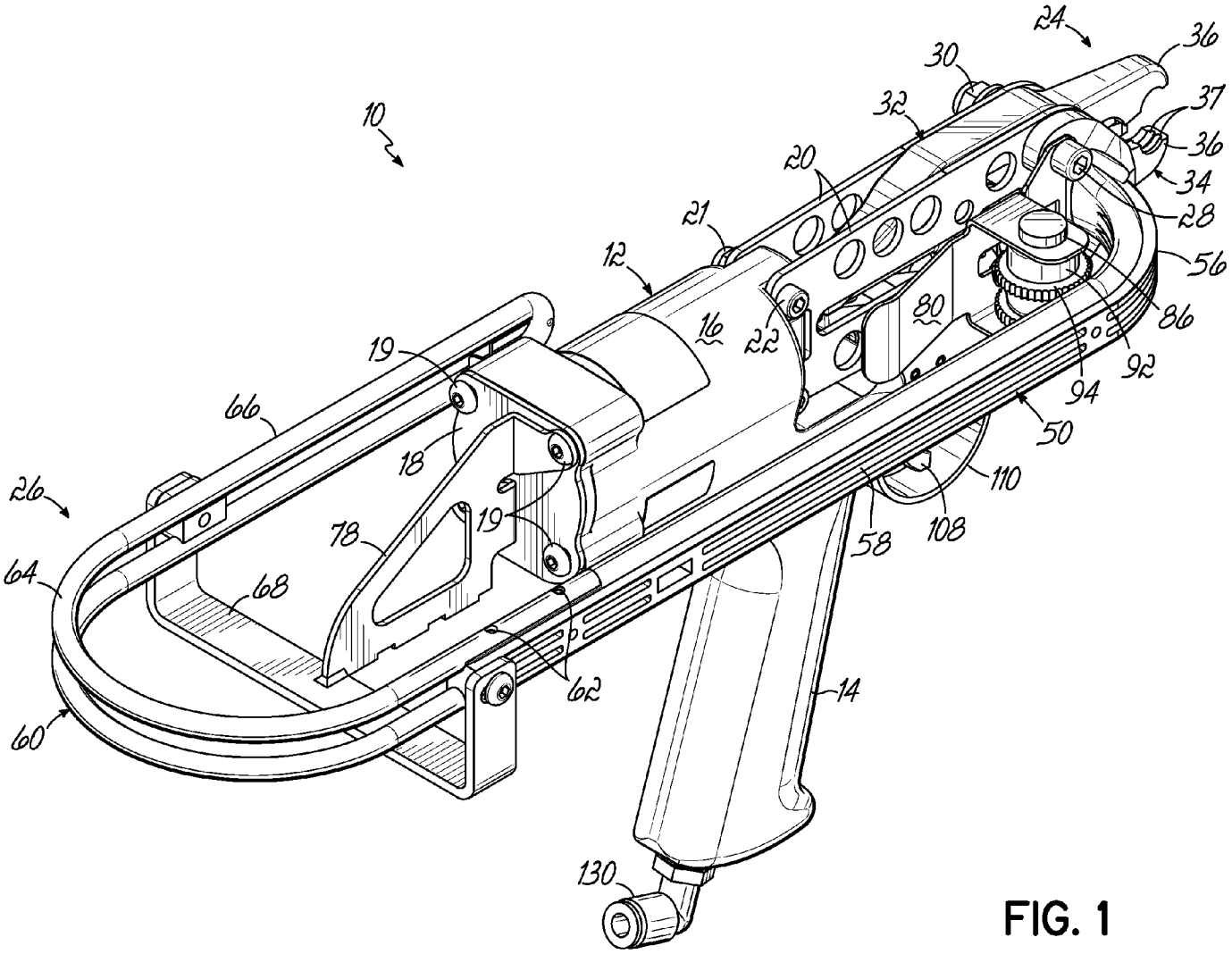
FIG. 1 is a rear perspective view of the clamping tool of the present invention.
Figure 3:
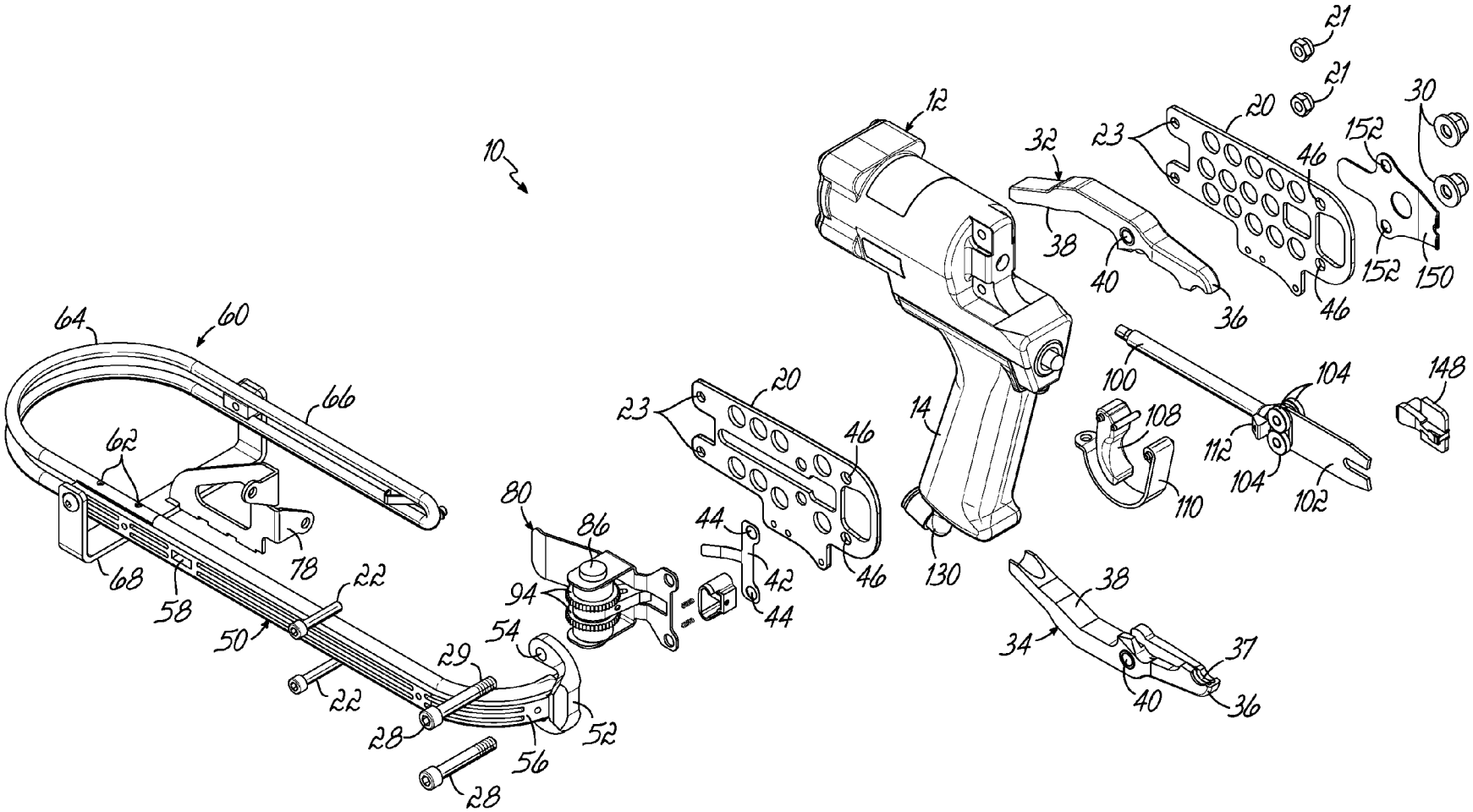
FIG. 3 is a partially disassembled perspective view of a portion of the tool of FIG. 1.

Referring to FIG. 1, an assembled clamping tool 10 for closing C-rings into hog rings is illustrated. The tool 10 has a body 12, including a handle 14 and a pneumatic cylinder 16. A rear plate 18 covers the back of the pneumatic cylinder 16 and is secured in place using four fasteners 19. As best shown in FIG. 3, two side plates 20 are bolted with bolts 22 to the front of the body 16 and extend forwardly from the body 16. As shown in FIG. 3, nuts 21 are secured to the ends of the bolts 22 after the bolts 22 pass through openings 23 in the side plates 20 when the tool is assembled. For reference purposes, in this document, number 24 refers to a front end of the tool 10, and number 26 refers to a rear end of the tool 10.

Figure 2:
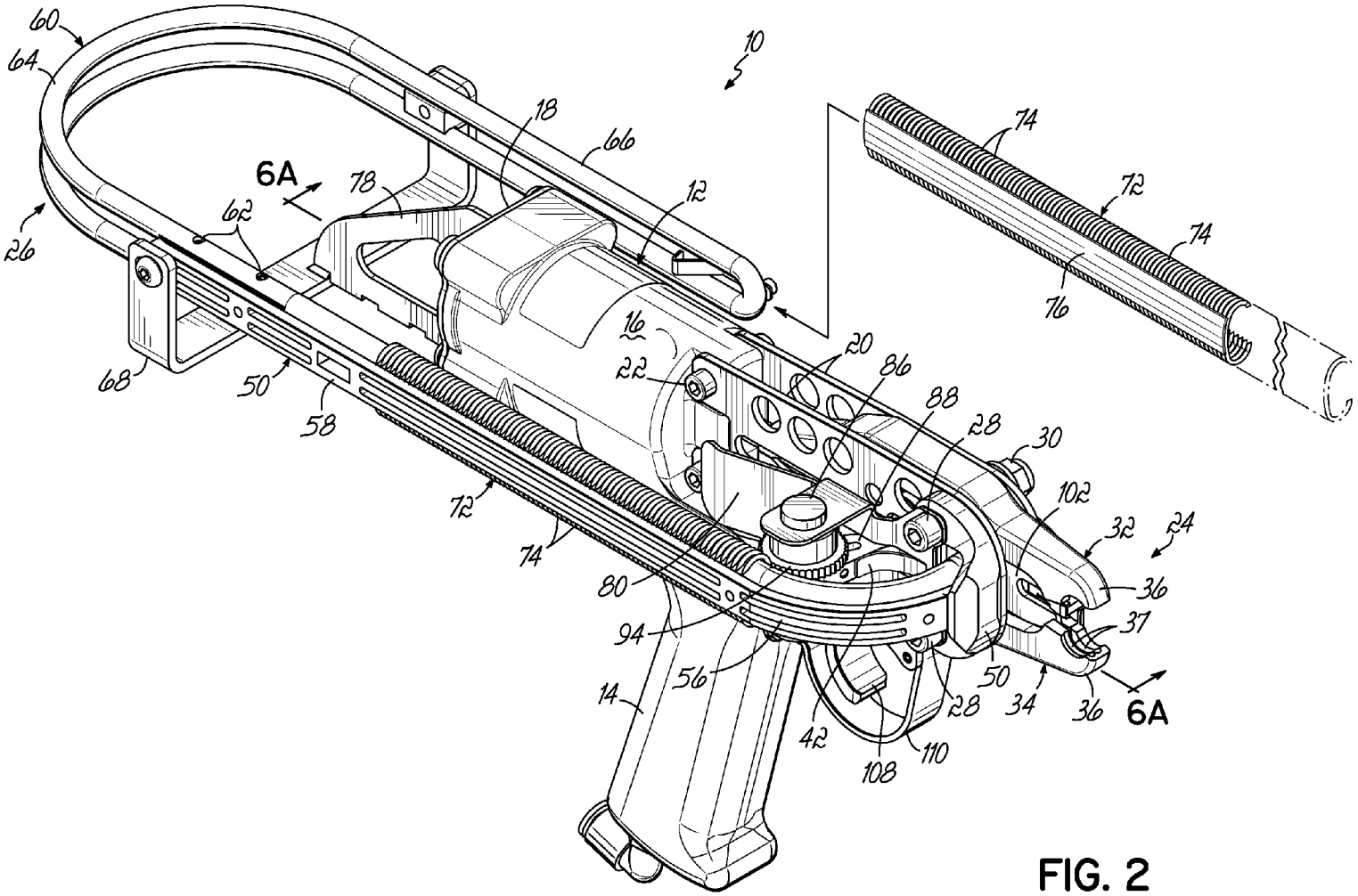
FIG. 2 is a front perspective view of the tool of FIG. 1 showing a group or string of C-rings joined together being inserted onto the magazine of the tool and another group on the magazine.
Figure 4:
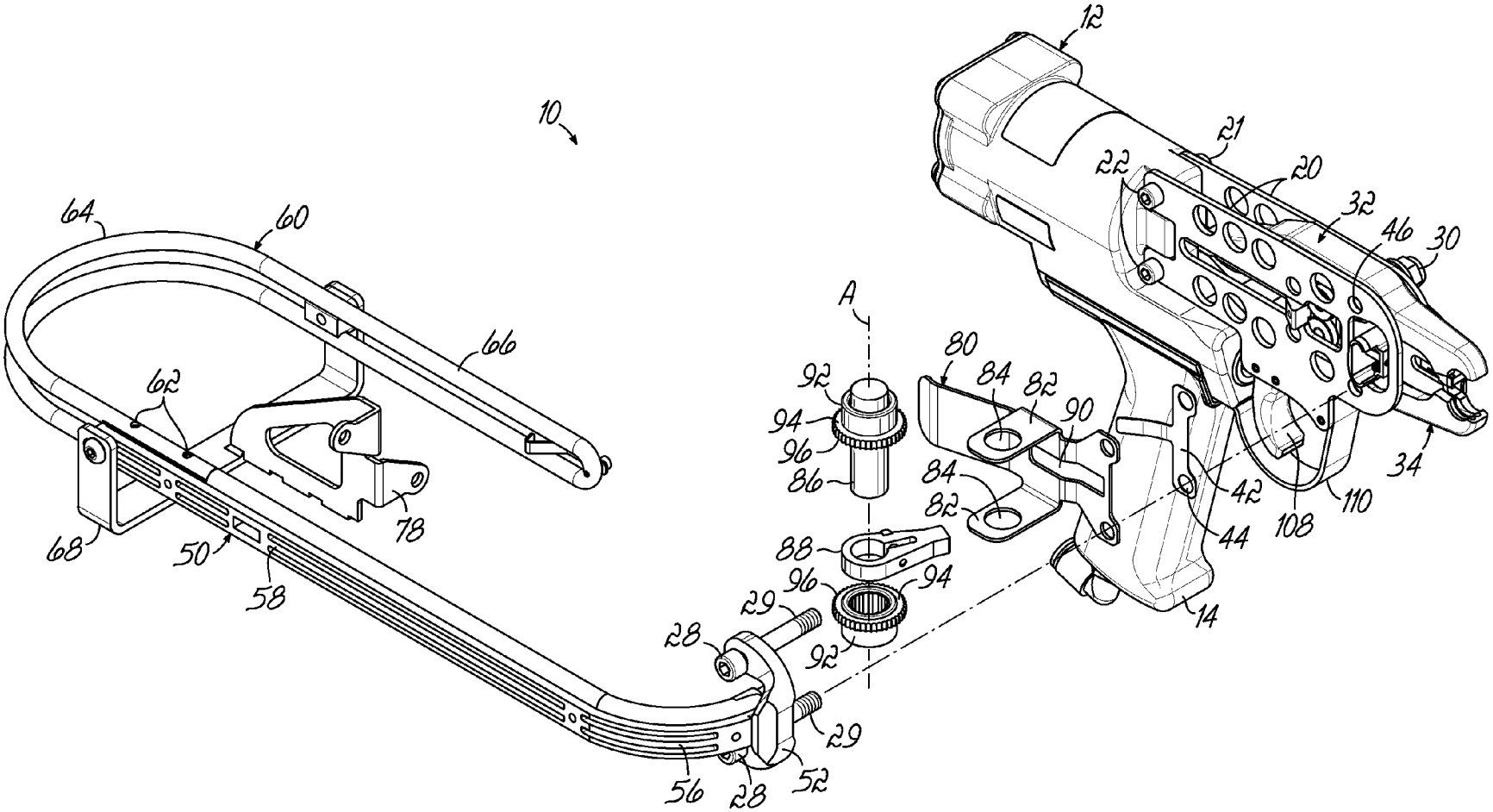
FIG. 4 is a partially disassembled perspective view of a portion of the tool of FIG. 1.

As shown in the drawings, and particularly FIG. 4, two threaded fasteners 28 having threaded ends 29 adapted to receive nuts 30 secure many pieces of the tool to the side plates 20. As shown in FIG. 3, the threaded fasteners 28 pass through openings 46 in the side plates 20. For example, upper and lower jaws 32, 34, each jaw having a curved front portion 36 and an inner surface 38, are pivotally secured between the side plates 20, the fasteners 28 extending through openings 40 in the upper and lower jaws 32, 34, respectively. See FIG. 3. As shown in FIGS. 1 and 2, each of the jaws 32, 34 has two grooves 37 therein. The operation of these jaws 32, 34 will be described in more detail below.

As shown in FIG. 3, a flat spring 42, generally in the shape of a "T", is secured to one of the side plates 20 using the two fasteners or bolts 28. As shown in FIG. 3, bolts 28 pass through openings 44 in the flat spring 42. As shown in FIGS. 1 and 2, outside of the flat spring 42, a curved magazine 50 having a mounting front portion 52 is secured with the two bolts 28 to one of the side plates 20. As shown in FIGS. 3 and 4, bolts 28 extend through openings 54 in the mounting portion 52 of the magazine 50. The magazine 50 has a curved front portion 56 and a straight portion 58. As shown in FIGS. 1 and 2, a magazine extension or loop guide 60 made of wire is attached to the rear of the magazine 50 with fasteners 62. Like the magazine 50, the loop guide 60 comprises a curved portion 64 and a straight portion 66. A generally U-shaped loop bracket 68 is secured to opposed sides of the combined magazine for stability. The combined magazine includes the magazine 50 and loop guide 60.

As best shown in FIGS. 2 and 4, a bundle or group 72 of C-rings 74 joined together with tape 76 are slid onto the loop guide 60 and pushed around the loop guide 60 to the magazine 50 and forwardly on the magazine, such that the tape 76 faces inwardly towards the center of the tool 10. As best shown in FIG. 1, a connector 78 extends between loop bracket 60 and the rear plate 18 of the tool body 12. Although one configuration of connector 78 is illustrated, other configurations or shapes of connectors may be used for stability and balance.

Figure 5:
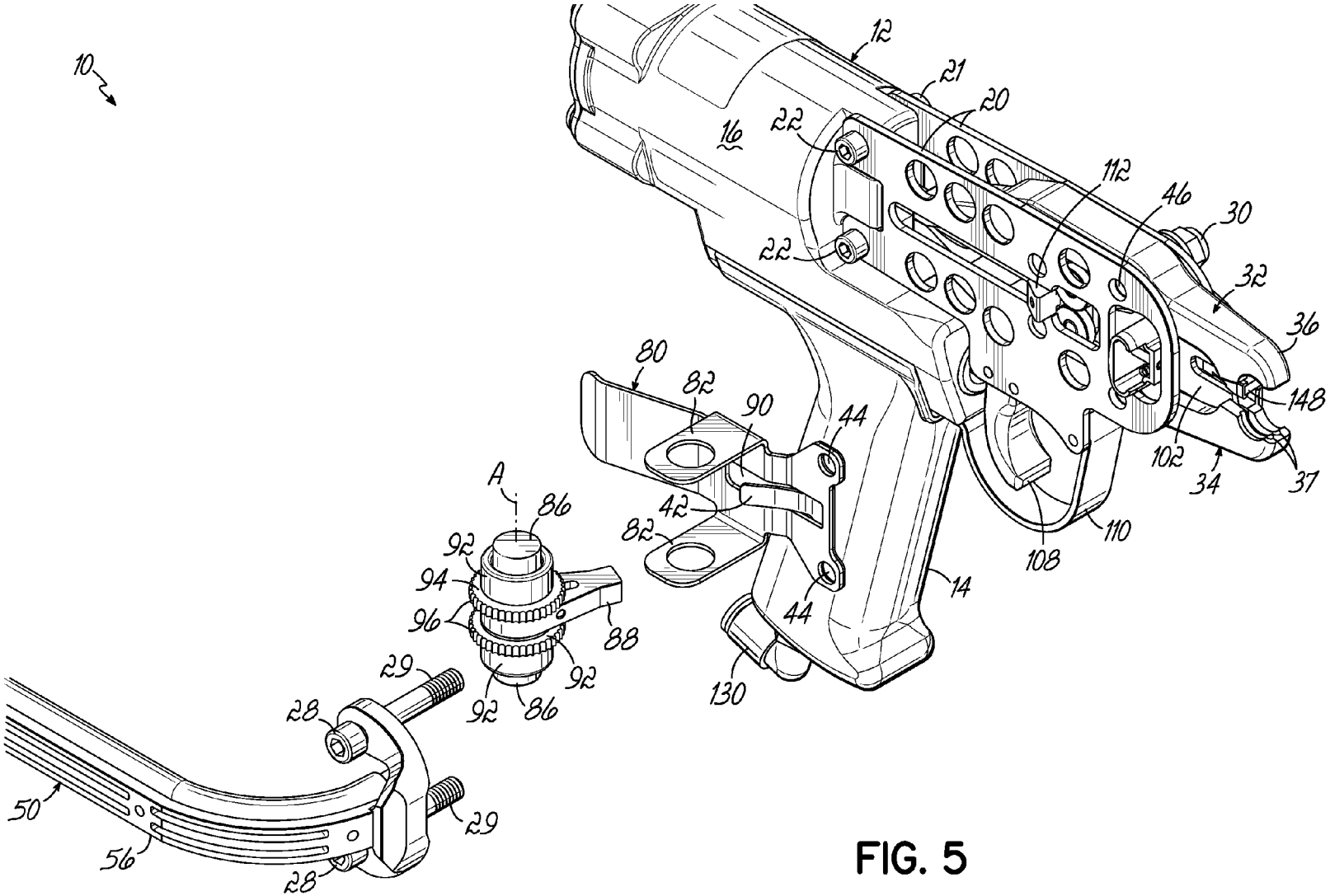
FIG. 5 is an enlarged partially disassembled perspective view of a portion of the tool of FIG. 1.

As best shown in FIGS. 4-5, a mounting bracket 80 having upper and lower flanges 82 is secured by the two bolts 28 to one of the side plates 20. As shown in FIGS. 4-5, each of the upper and lower flanges 82 has an opening 84 therethrough adapted to receive a shaft 86 have an axis A. The shaft 86 is able to reciprocate or pivot about the axis A. Again, as best shown in FIGS. 4-5, a clamp 88 is fixedly secured to the shaft 86 and pivots with the shaft 86. When assembled, as shown in FIG. 3, the clamp 88 extends through a slot 90 in the mounting bracket 80. Movement or travel of clamp 88 is limited by the size of the slot 90 in the clamp 88. As shown in FIG. 4, two one-way bearings 92 surround the shaft 86 and are able to turn in only one direction. A one-way roller bearing which has proven suitable for this application is sold by McMaster-Carr. A feed roller 94 having teeth 96 around the perimeter of the feed roller 94 is attached to each one-way bearing 92. Thus, the shaft 86 passes through two one-way bearings 92, two feed rollers 94 and a clamp 88.

Figure 6A:
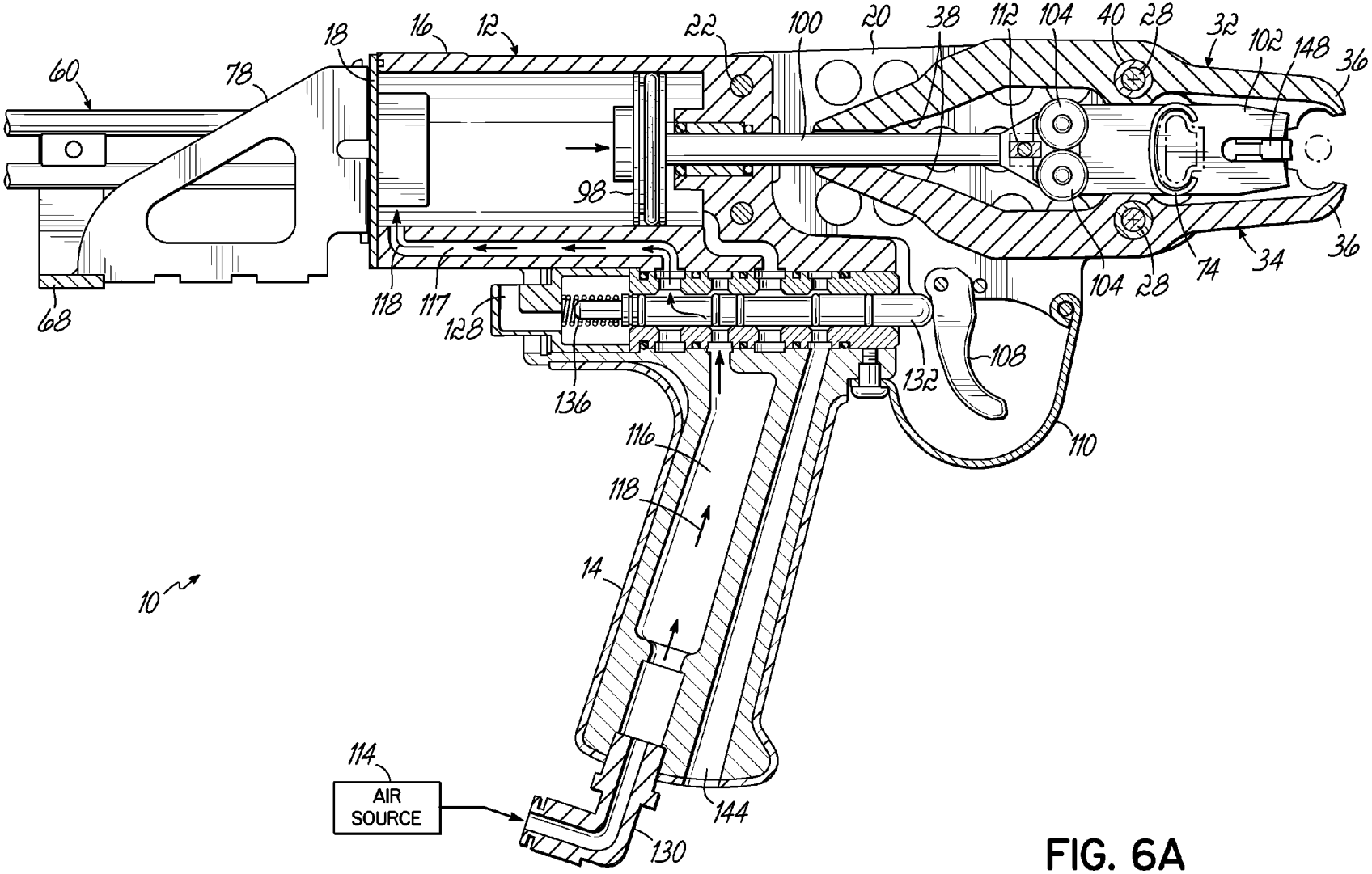
FIG. 6A is a cross-sectional view of a portion of the tool of FIG. 1 showing the airflow.
Figure 6B:
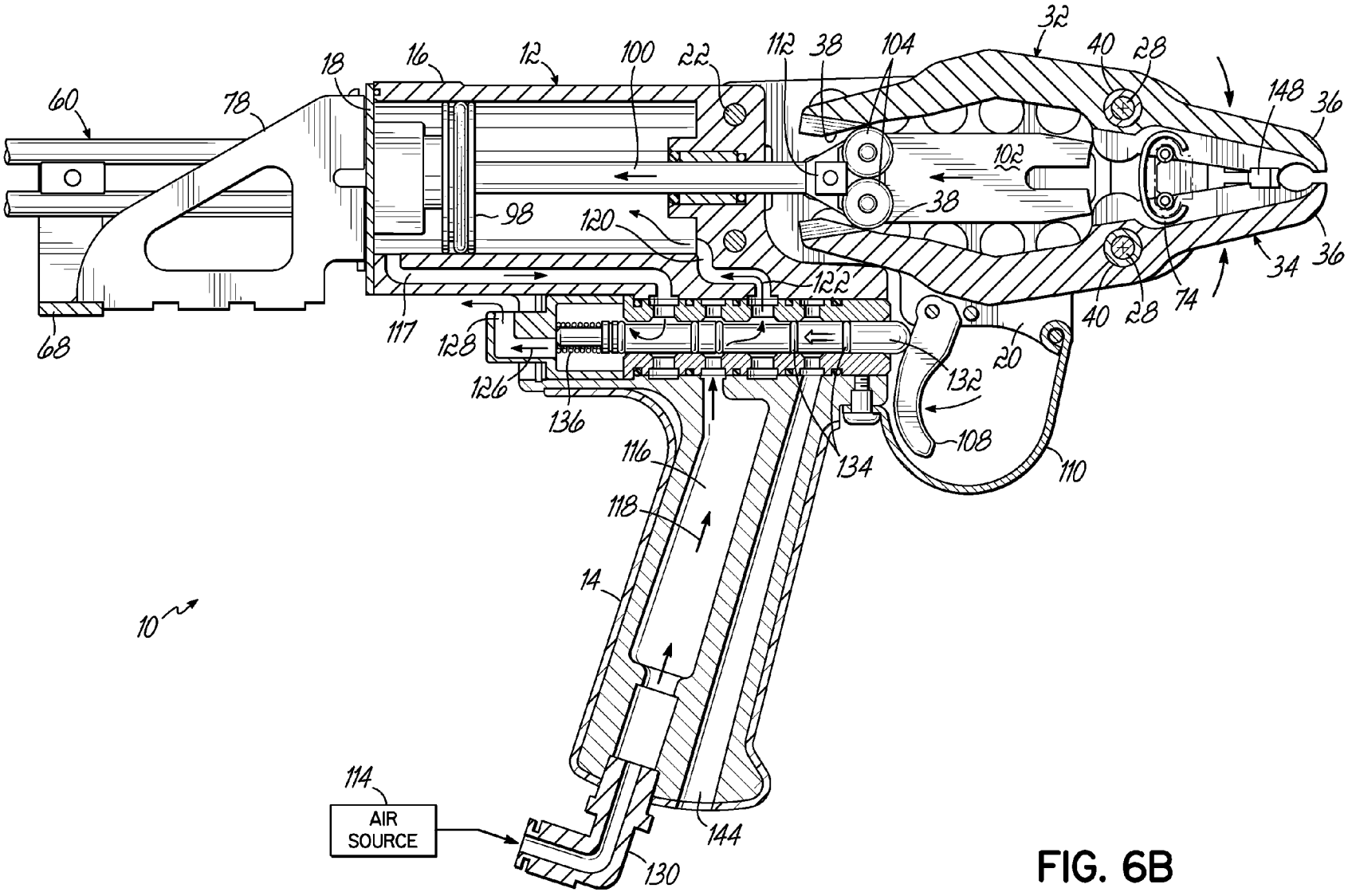
FIG. 6B is a cross-sectional view of a portion of the tool of FIG. 1 showing the airflow while the piston is moving rearwardly.
Figure 6C:
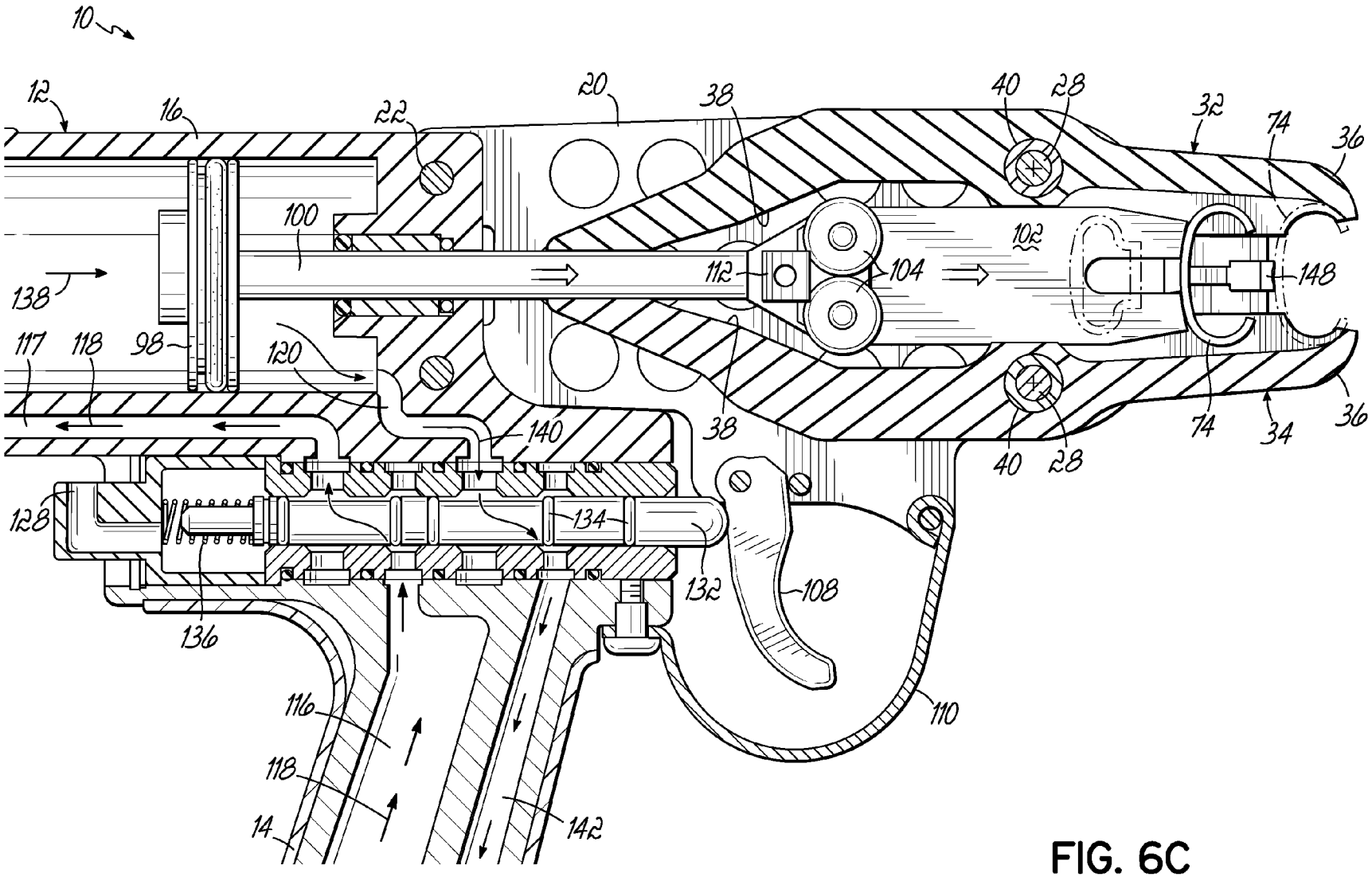
FIG. 6C is a cross-sectional view of a portion of the tool of FIG. 1 showing the airflow while the piston is moving forwardly.
Figure 6D:
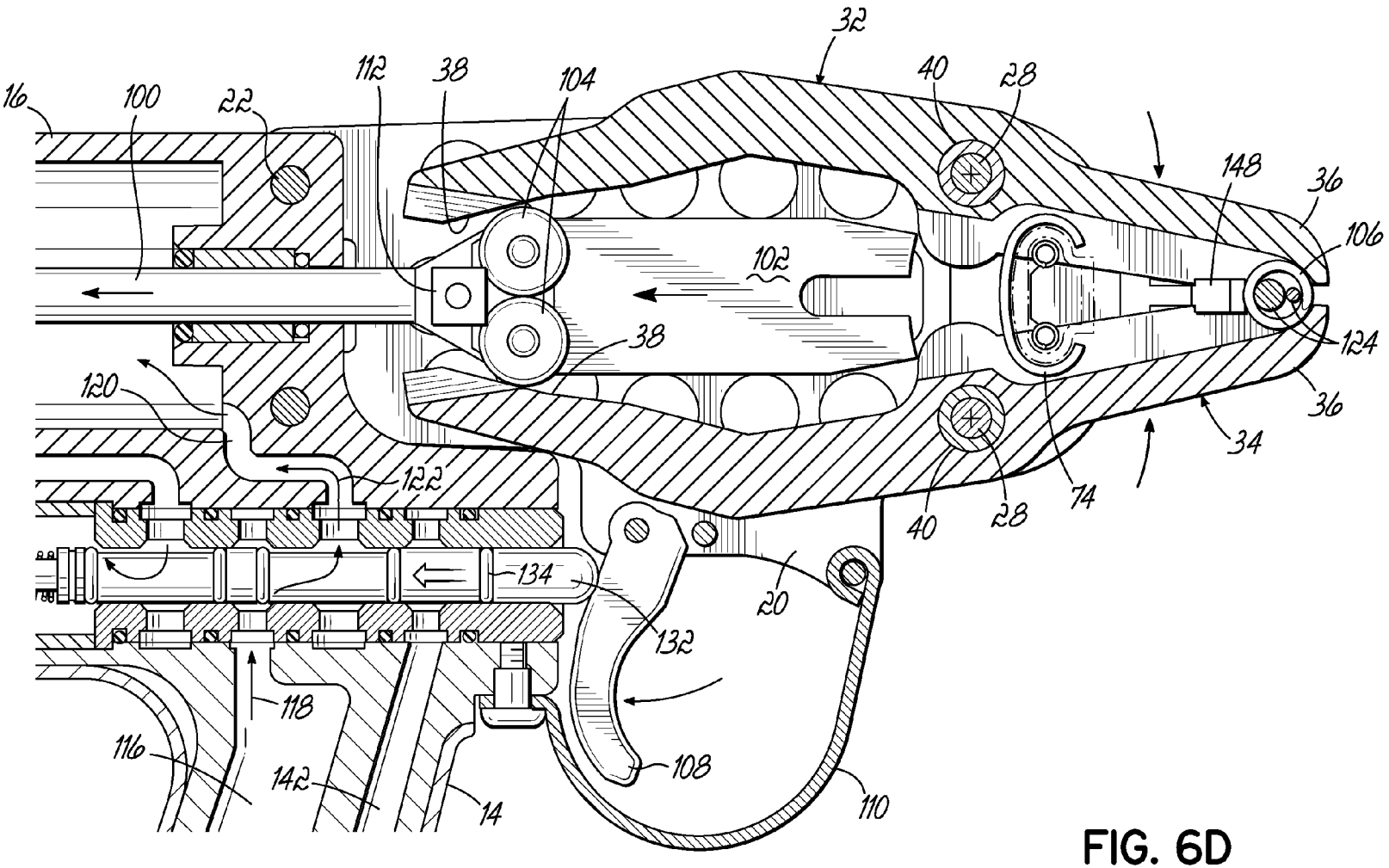
FIG. 6D is a cross-sectional view of a portion of the tool of FIG. 1 showing the hog ring between the closed front portions of the jaws.

As best shown in FIGS. 6A-6C, a piston 98 moves inside the pneumatic cylinder 16 due to air flow into and out of the cylinder 16, as will be described below. A piston rod 100 extends forwardly from the piston 98 and moves with the piston 98 between a forward position and a rear position. The piston rod 100 is located between the side plates 20 and is attached at its front end to a feeder blade 102. The feeder blade 102 aids in moving one of the C-rings 74 into a ready position to be closed by the jaws 32, 34. As shown in FIG. 3, four rollers 104 are attached to the feeder blade 102, two per side. The four rollers 104 function to contact the inner surfaces 38 of the upper and lower jaws 32, 34 to open and close the jaws 32, 34 as the piston rod 100 moves. As shown in FIG. 6D, when the piston rod 100 moves rearwardly to its rear position, the rollers 104 contact the inner surfaces 38 of jaws 32, 34 and close the jaws around a C-ring to close the C-ring around multiple members 124, such as wires, for example, and create a hog ring 106.

Figure 7A:
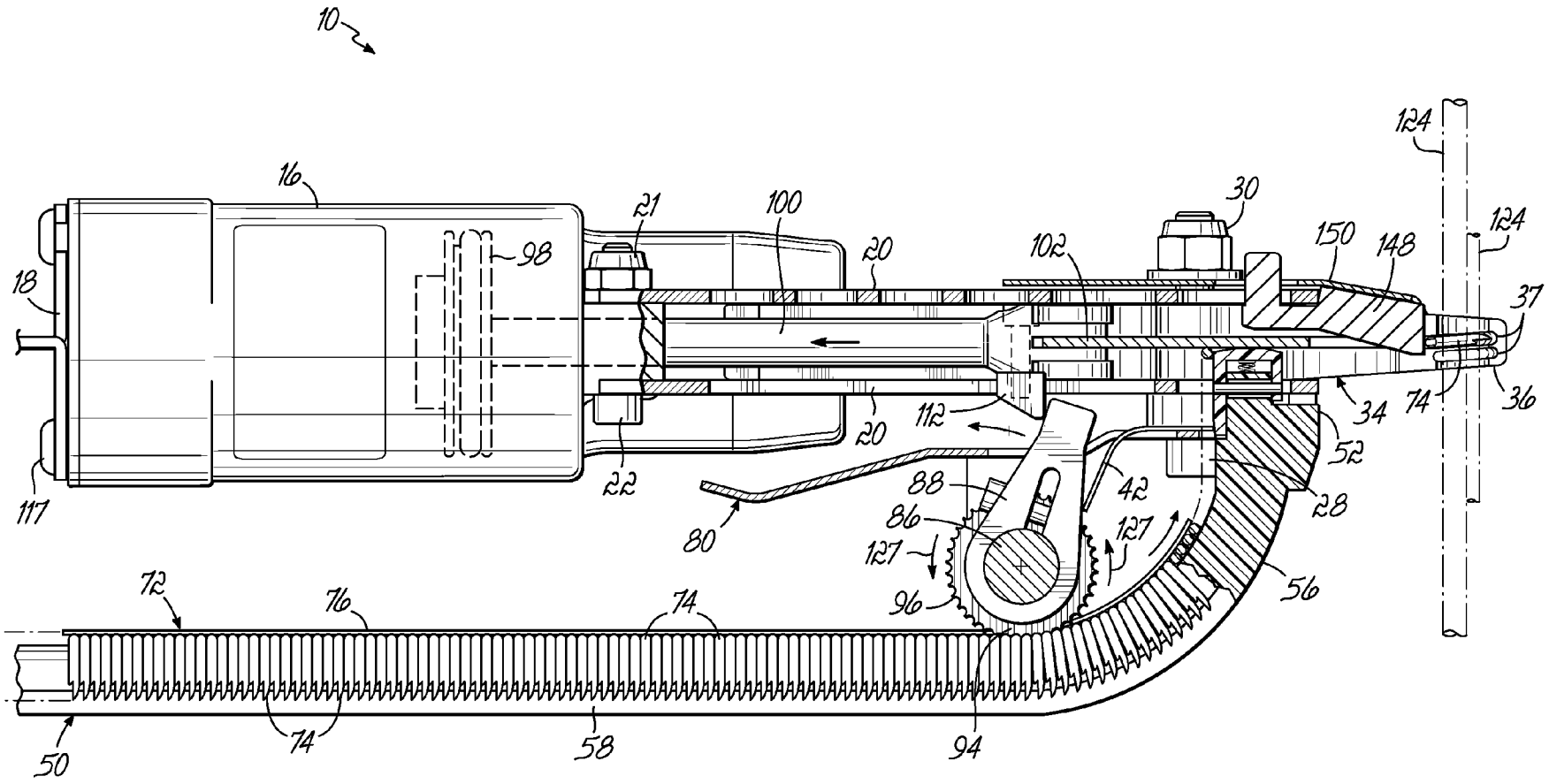
FIG. 7A is a top plan view, partially broken away, of a portion of the tool of FIG. 1 showing the piston rod moving rearwardly.

In operation, when a trigger 108 located between the side plates 20, protected with a trigger protector 110, is pulled, a pusher 112 attached to the piston rod 100 moves rearwardly with the piston rod 100. FIG. 6A shows the tool in an "at rest" position with the piston 98 located at the front of the cylinder 16. Air is directed from an air source 114 through a coupling 130, through a handle passage 116 extending through the handle 14, through an interior passage 117 below the cylinder 16, and into the cylinder 16 in a direction shown by arrows 118. As shown in FIG. 7A, when the piston 98 is in its neutral or "at rest" position, the pusher 112 is slightly to the left or rearwardly of the clamp 88. As shown in FIG. 7A, flat spring 42 exerts a force on the clamp 88, but does not move the clamp 88 due to the presence of the pusher 112.

As shown in FIG. 6B, when the trigger 108 is pulled, a plunger 132 is moved rearwardly, changing the position of the O-rings 134 attached to the plunger 132 allowing air from the air source 114 to flow through passage 116 extending through the handle 14, through an interior passage 120 in the direction of arrows 122 into the cylinder 16 in front of the piston 98, causing the piston 98, piston rod 100 and pusher 112 attached to the piston rod 100 to move rearwardly (to the left as shown in FIG. 6B). Air previously behind piston 98 exits the tool at the rear of the tool 10 via passage 117 in the direction of arrows 126 and out an exit port 128 shown in FIG. 6B.

As shown in FIG. 6B, when the trigger 108 is pulled rearwardly, causing the piston 98 and piston rod 100 to move rearwardly, the rollers 104 attached to the feeder blade 102 contact the inner surfaces 38 of the jaws 32, 34 to pivot the jaws and close front ends 36 of jaws 32, 34 around a C-ring to close the C-ring and create a hog ring 106 around two pieces of wire 124 (see FIG. 7A).

Figure 7B:
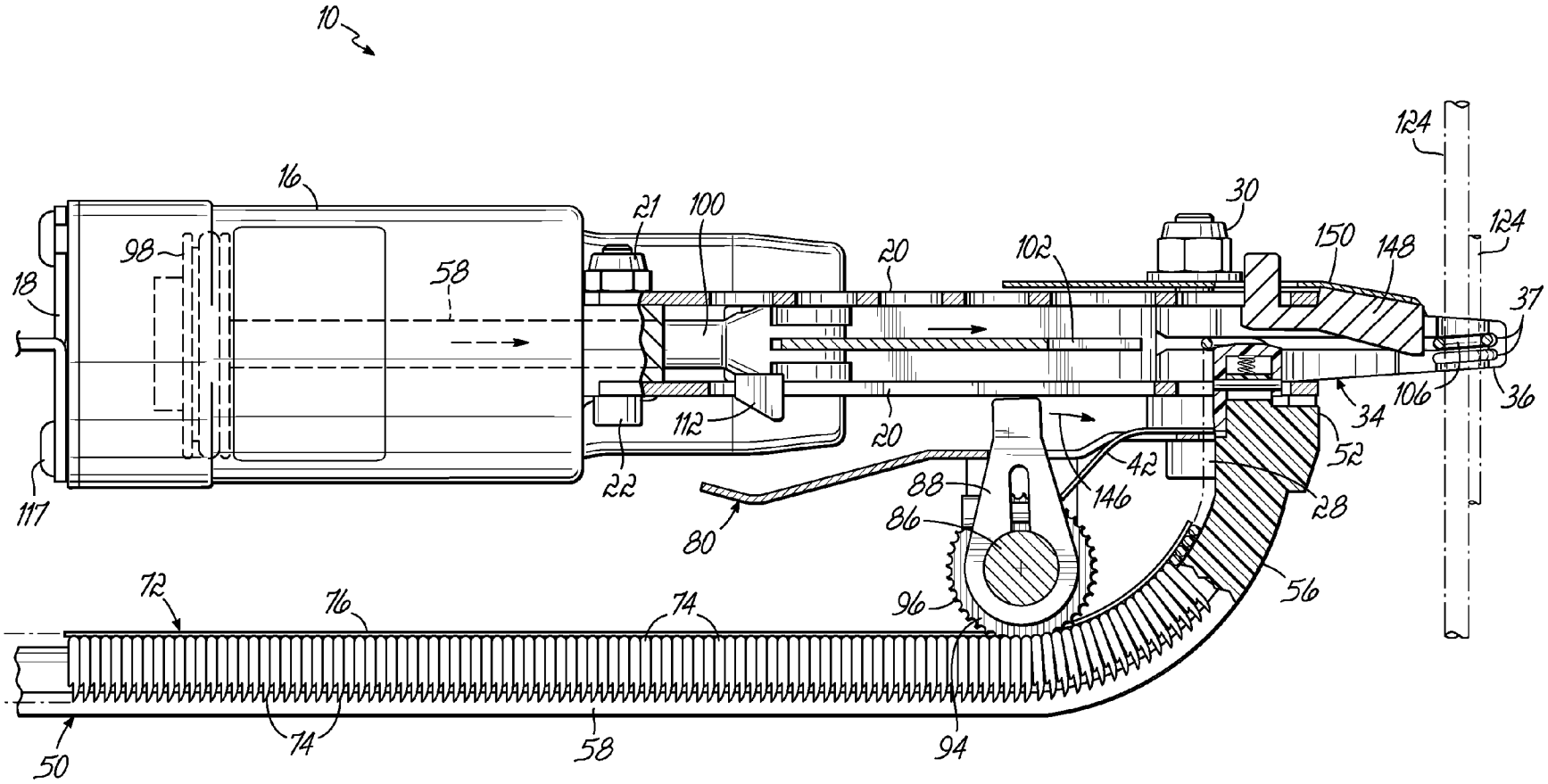
FIG. 7B is a top plan view, partially broken away, of a portion of the tool of FIG. 1 showing the piston rod moving forwardly.

As shown in FIG. 7B, with the pusher 112 (attached to the piston rod 100) moved to the rear, the flat spring 42 extending through the slot 90 in the mounting bracket 80 moves the clamp 88 in a counter-clockwise direction (when viewed from the top of the tool). As shown in FIG. 7A, such counter-clockwise movement of the clamp 88 (when viewed from the top of the tool) pivots the shaft 86 and the feed rollers 94 in a counter-clockwise direction (when viewed from the top of the tool) shown by arrows 127 due to the operation of the one-way bearings 92. The teeth 96 of the two feed rollers 94 contact the string of C-rings and cause the C-rings to advance or move forwardly one at a time. The forwardmost C-ring is pushed by the feeder blade 102 to a position in which, upon the next pull of the trigger 108, the forwardmost C-ring may be closed.

As shown in FIG. 6C, when the operator releases the trigger 108, the spring loaded plunger 132 is moved forwardly by the force of a spring 136, changing the position of the O-rings 134. Movement of the plunger 132 allows air to flow from air source 114 through the handle passage 116 and through passage 117 in the direction of arrows 118 into the cylinder 16 behind the piston 98. This air movement causes the piston 98 and piston rod 100 to move forwardly in the direction of arrow 138, causing air in front of the piston 98 to exit the cylinder 16 through interior passage 120 in the direction of arrows 140, around the plunger 132 and out the tool via an exit port 144 at the end of air passage 142 extending through handle 14. Exit port 144 is shown in FIG. 6B.

Figure 7C:
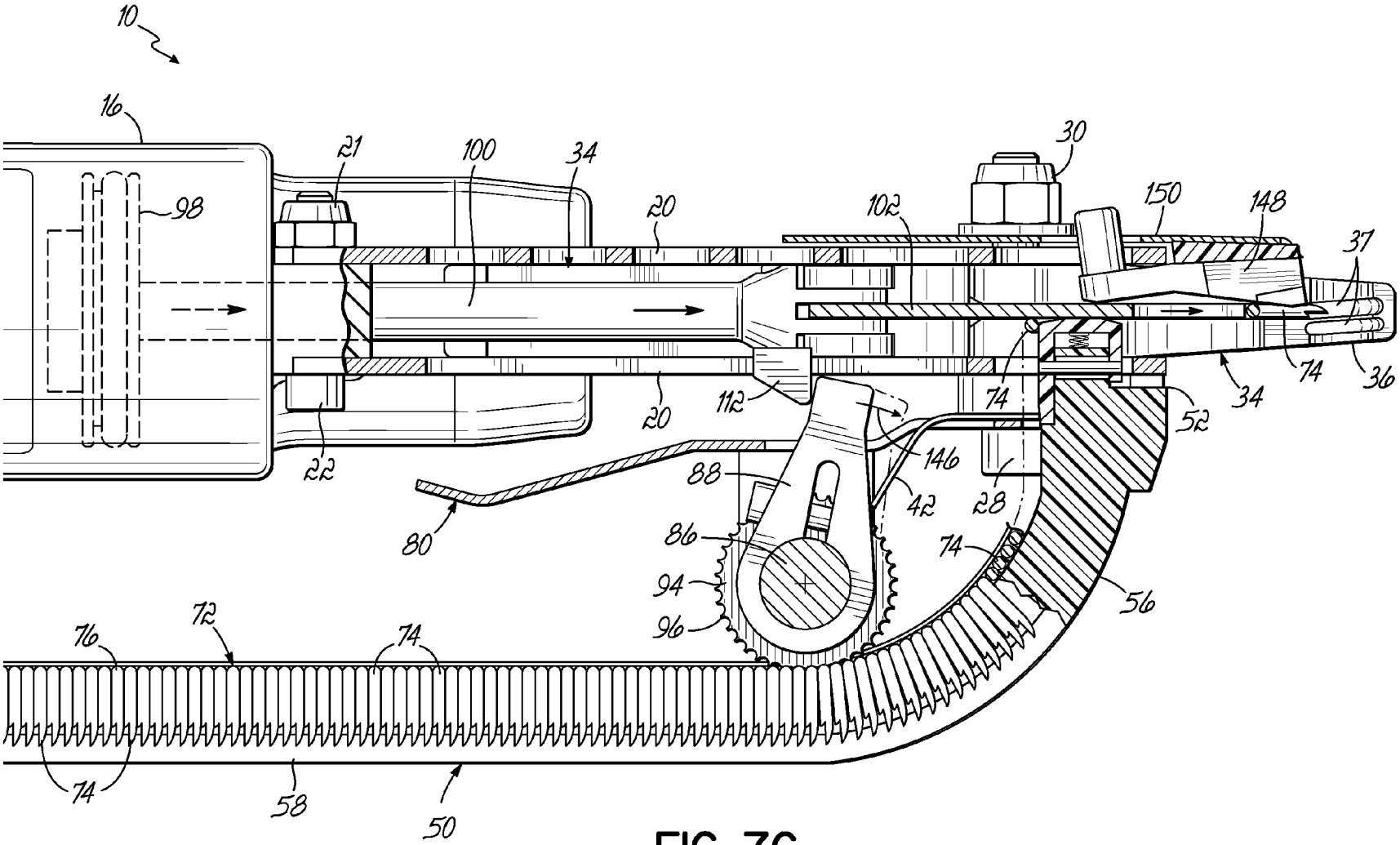
FIG. 7C is another top plan view, partially broken away, of a portion of the tool of FIG. 1 showing the piston rod moving forwardly.
Figure 8:
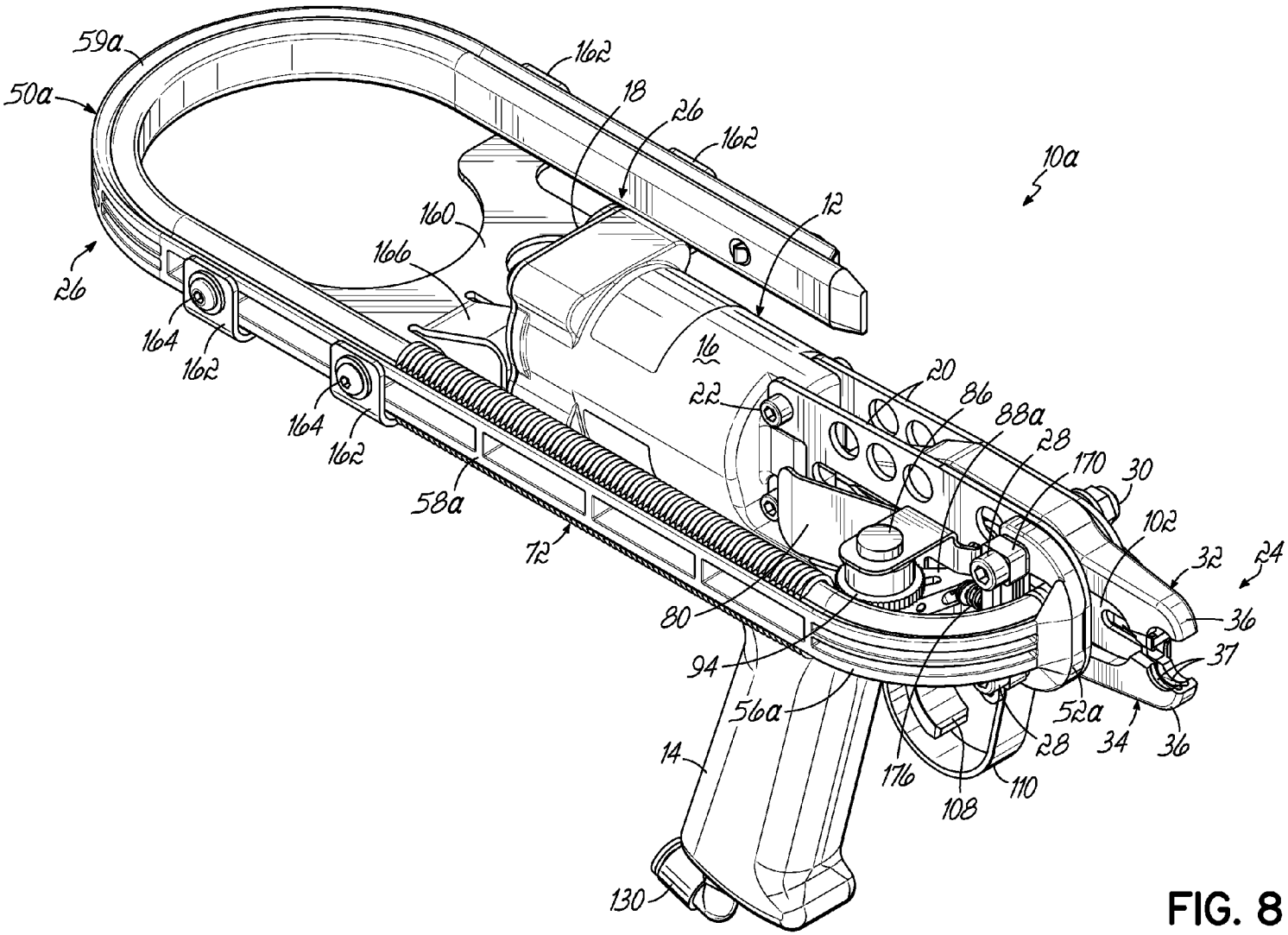
FIG. 8 is a front perspective view of an alternative embodiment of clamping tool.

While the spring 136 is moving the plunger 132 forwardly and the trigger 108 back to its "at rest" or forward position, and the piston 98 and piston rod 100 are moving forwardly, the pusher 112 contacts the clamp 88 and moves it in a clockwise direction shown by arrow 146 in FIG. 7C (when viewed from the top of the tool). This clockwise pivot or movement of the clamp 88 pivots or rotates the clamp 88 and shaft 86 without pivoting or moving the feed rollers 94 due to the operation of the one-way bearings. This clockwise pivoting or rotational movement of the clamp 88 further loads or energizes the flat spring 42. Upon the next release or pull of the trigger, the process repeats itself.

As shown in FIGS. 3 and 7A-7C, on the side of the tool opposite the magazine 50, a latch 148 for moving the forwardmost C-ring into a position for closing is located. Outside the latch 148, a spring latch 150 holds the latch 148 in place. More specifically, fasteners 28 extend through openings 152 in the spring latch 150. See FIG. 3.

FIGS. 8-11D illustrate an alternative embodiment of clamping tool 10*a* for closing C-rings into hog rings. For simplicity, the same numbers will be used for the same parts of the embodiment shown in FIGS. 1-7C.

Figure 9:
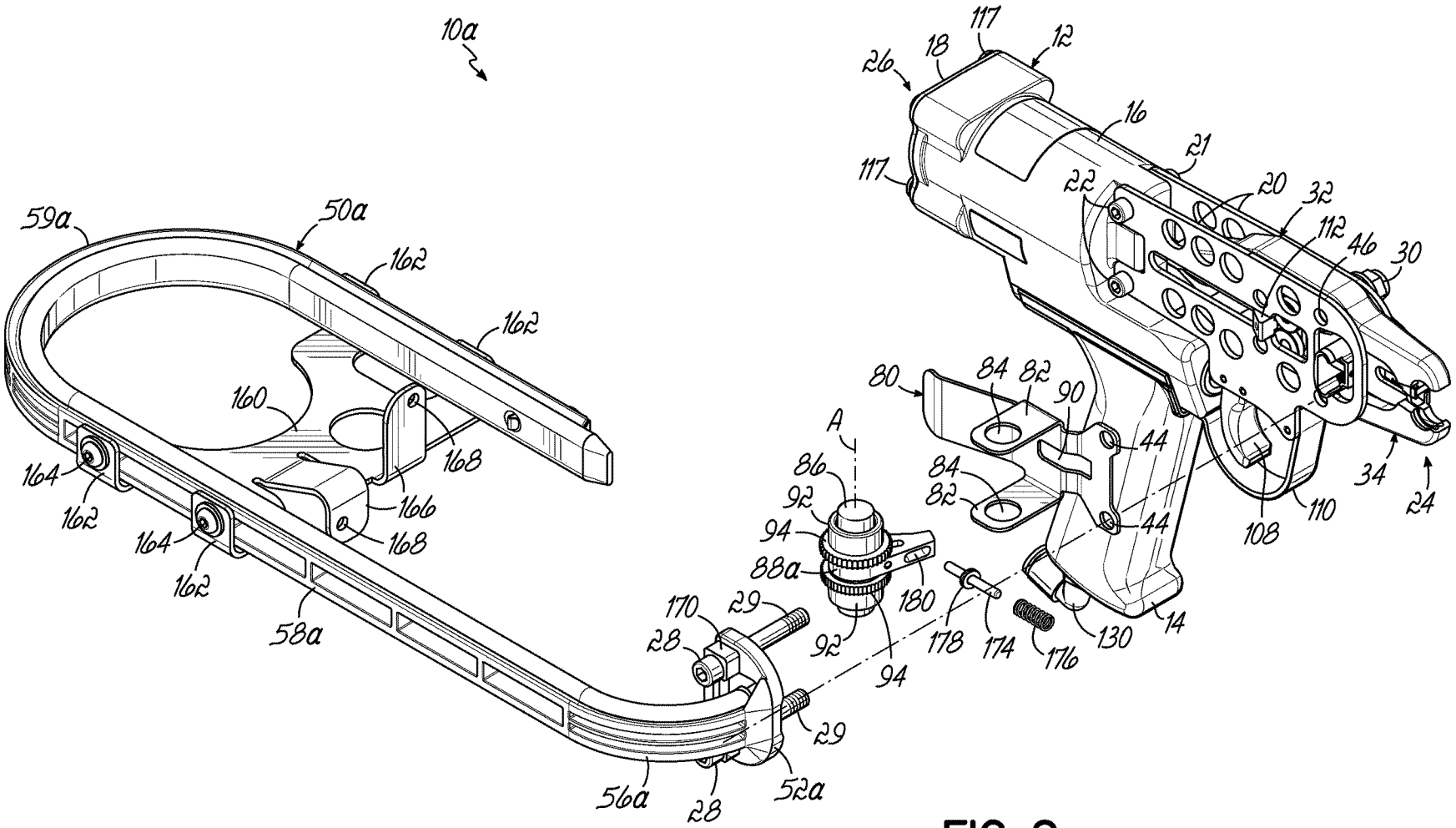
FIG. 9 is a partially disassembled perspective view of a portion of the tool of FIG. 8.
Figure 10:
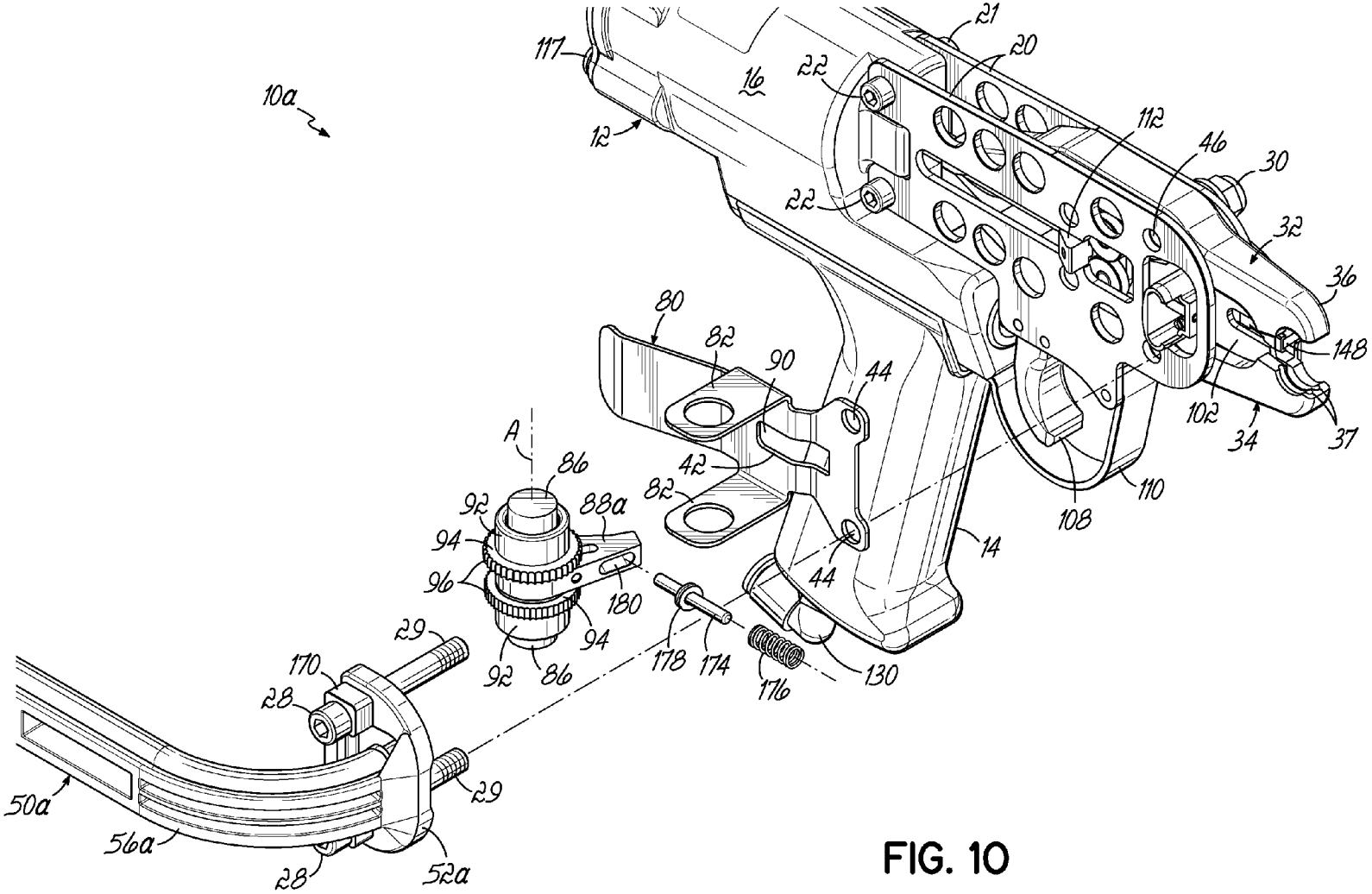
FIG. 10 is an enlarged partially disassembled perspective view of a portion of the tool of FIG. 8.

This embodiment of clamping tool 10*a* utilizes a one-piece magazine 50*a* rather than a two-piece magazine 50, 60. The unitary magazine 50*a* is preferably made of plastic, but may be made of any desired material. This embodiment of clamping tool 10*a* lacks a wire magazine extension or loop guide 60. Consequently, the magazine 50*a* profile guards the sharp tips of the C-rings throughout the length of the magazine, as opposed to through only a portion of the magazine. As best illustrated in FIG. 9, the unitary magazine 50*a* has a mounting front portion 52*a* which, when assembled, is secured to one of the side plates 20 with two threaded fasteners 28. Each of the threaded fasteners 28 has a threaded end 29 adapted to receive a nut 30 to secure many pieces of the tool to the side plates 20. As shown in FIGS. 9 and 10, bolts or fasteners 28 extend through openings (not shown) in the mounting portion 52*a* of the magazine 50*a*. The magazine 50*a* has a curved front portion 56*a*, including the mounting portion 52*a*, a straight portion 58*a* and a rear curved portion 59*a*.

Figure 11A:
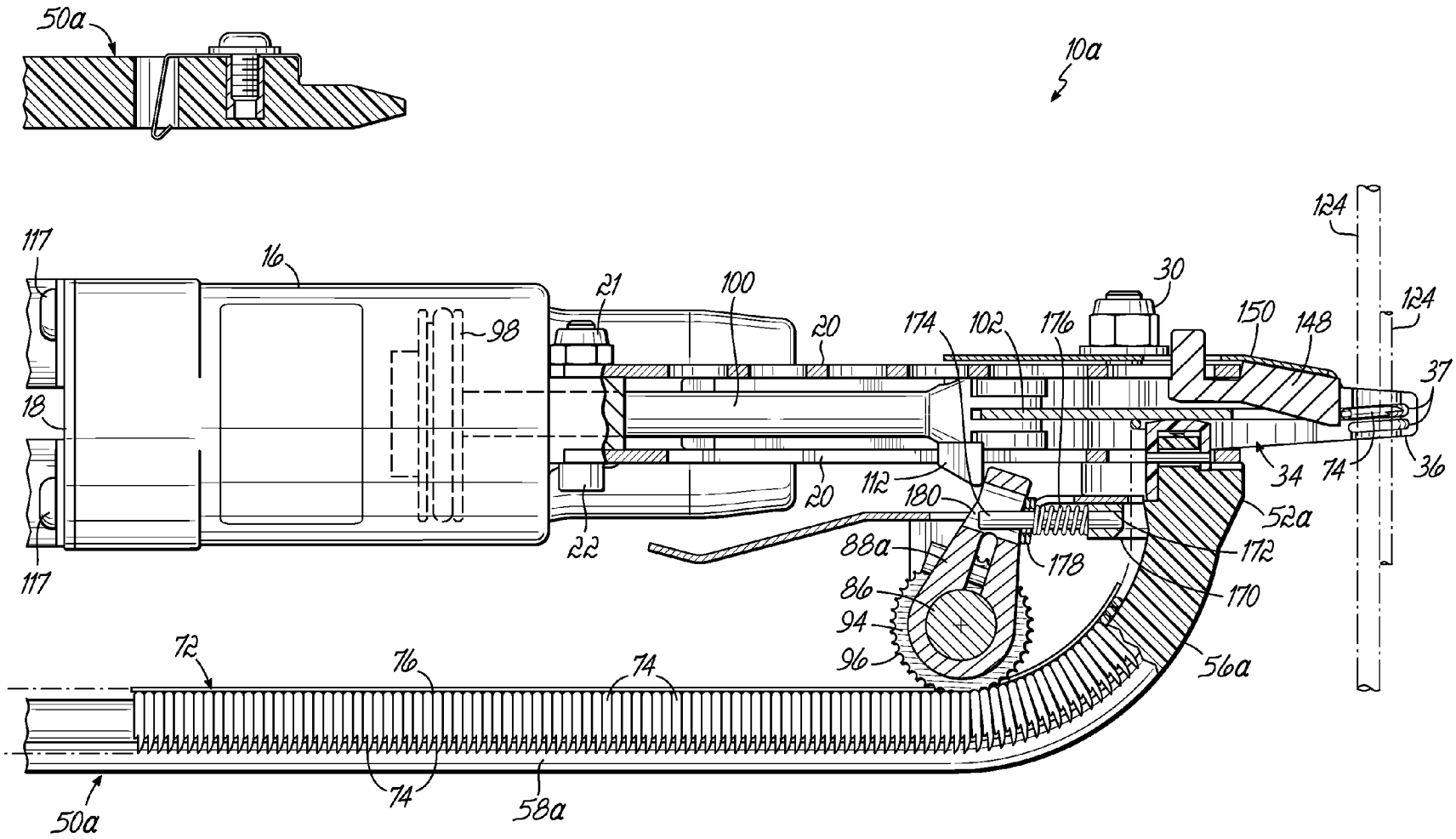
FIG. 11A is a cross-sectional view of a portion of the tool of FIG. 8 showing the piston before the trigger is pulled.

As best shown in FIG. 9, this embodiment of clamping tool 10*a* utilizes a unitary bracket 160 in place of the generally U-shaped loop bracket 68 and connector 78 of the first embodiment. Four legs 162 of unitary bracket 160 (two per side) are secured to opposed sides of the magazine 50*a* with fasteners 164 for stability. As shown in FIG. 9, unitary bracket 160 further comprises two tabs 166, each tab 166 having an opening 168 therethrough. As seen in FIG. 11A, fasteners 19 pass through the openings 168 in tabs 166 and secure the tabs 166 of the unitary bracket 160 to the pneumatic cylinder 16 and, more particularly, to the rear plate 18 of the pneumatic cylinder 16 of the tool body 12. Although one configuration of unitary bracket 160 is illustrated, other configurations or shapes of brackets of one or more pieces may be used for stability and balance.

Figure 11B:
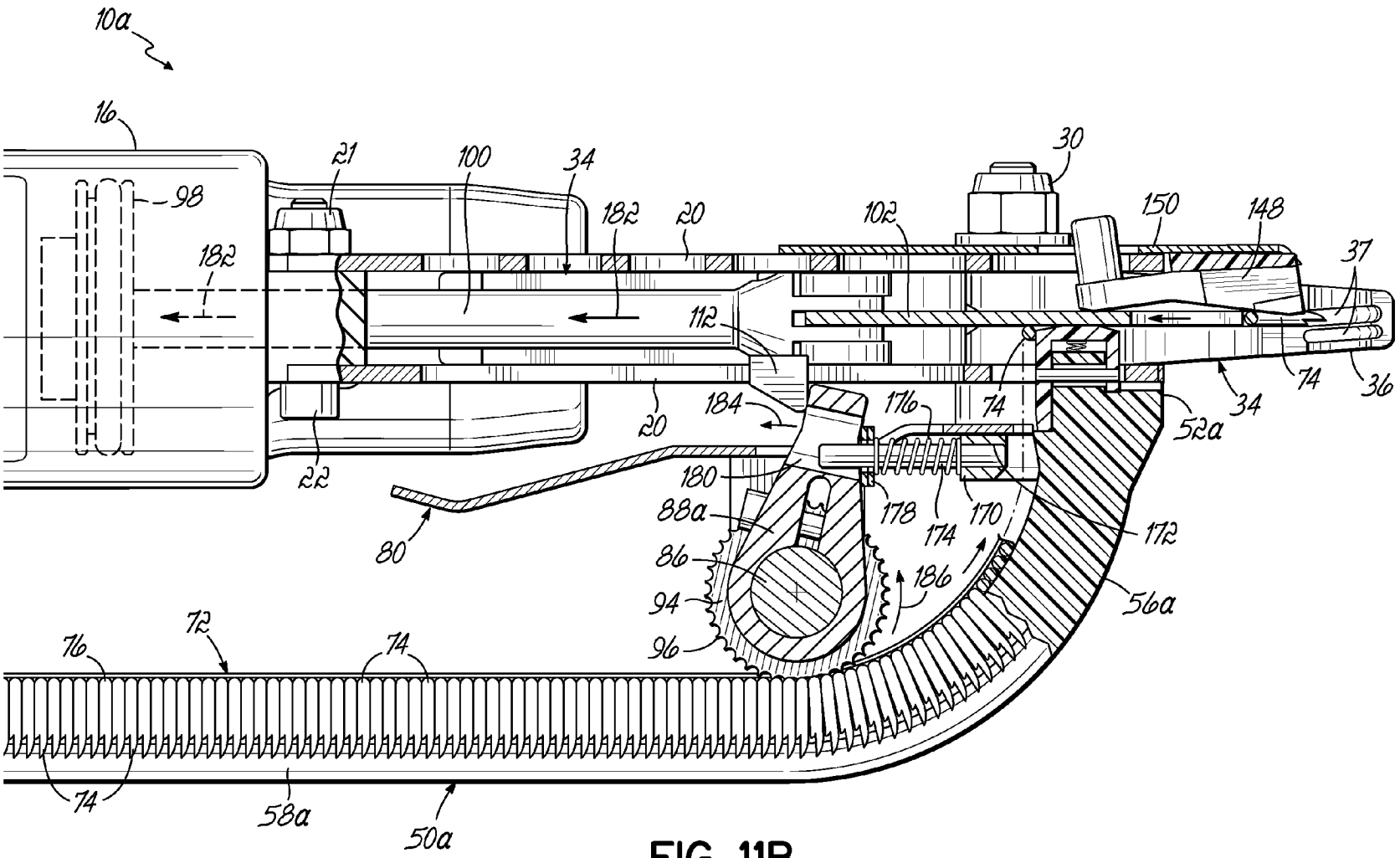
FIG. 11B is a cross-sectional view of a portion of the tool of FIG. 8 showing the piston moving rearwardly during the pulling of the trigger.
Figure 11C:
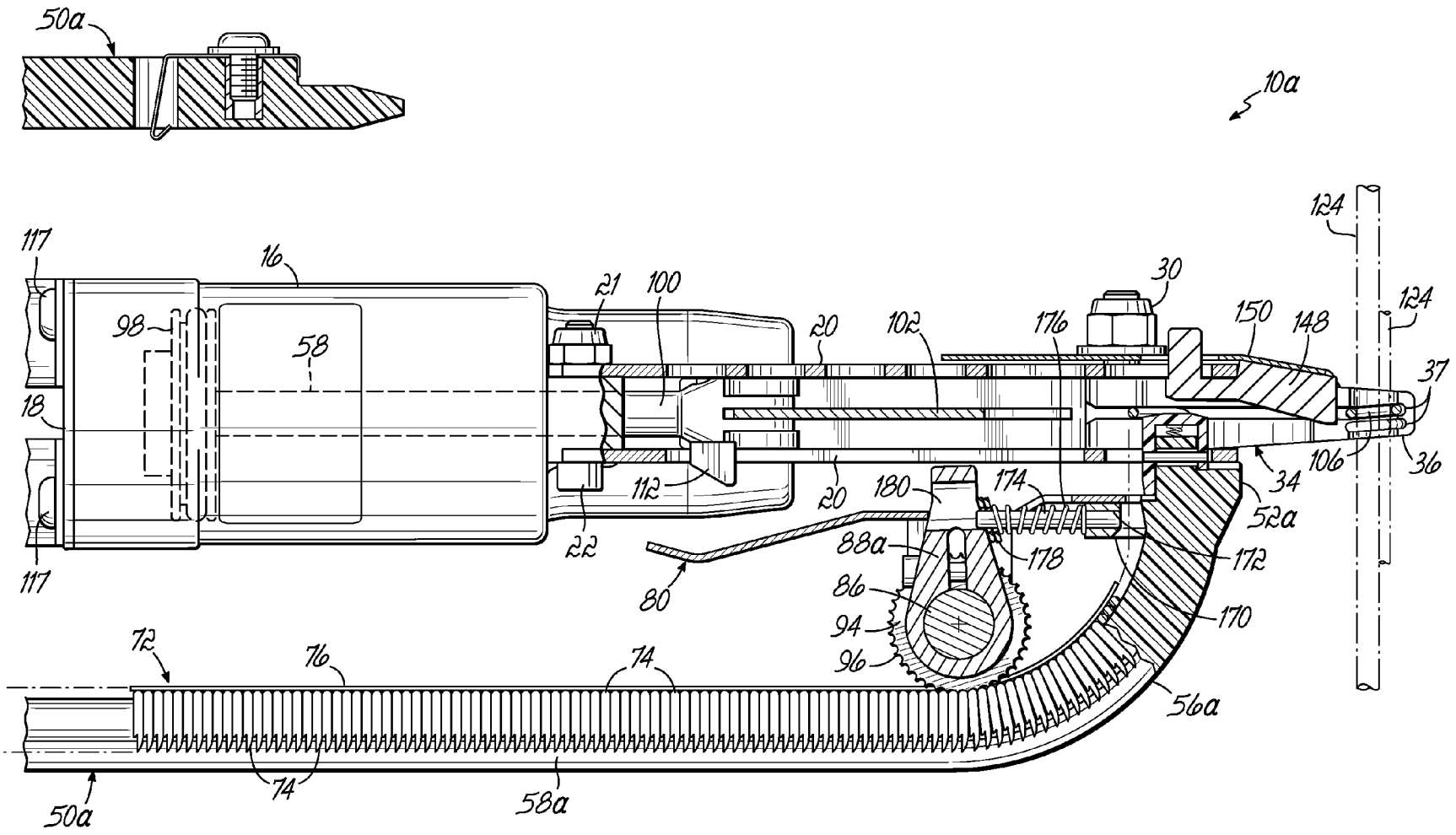
FIG. 11C is a cross-sectional view of a portion of the tool of FIG. 8 showing the piston in its rearwardmost position with the trigger being held towards the operator.
Figure 11D:
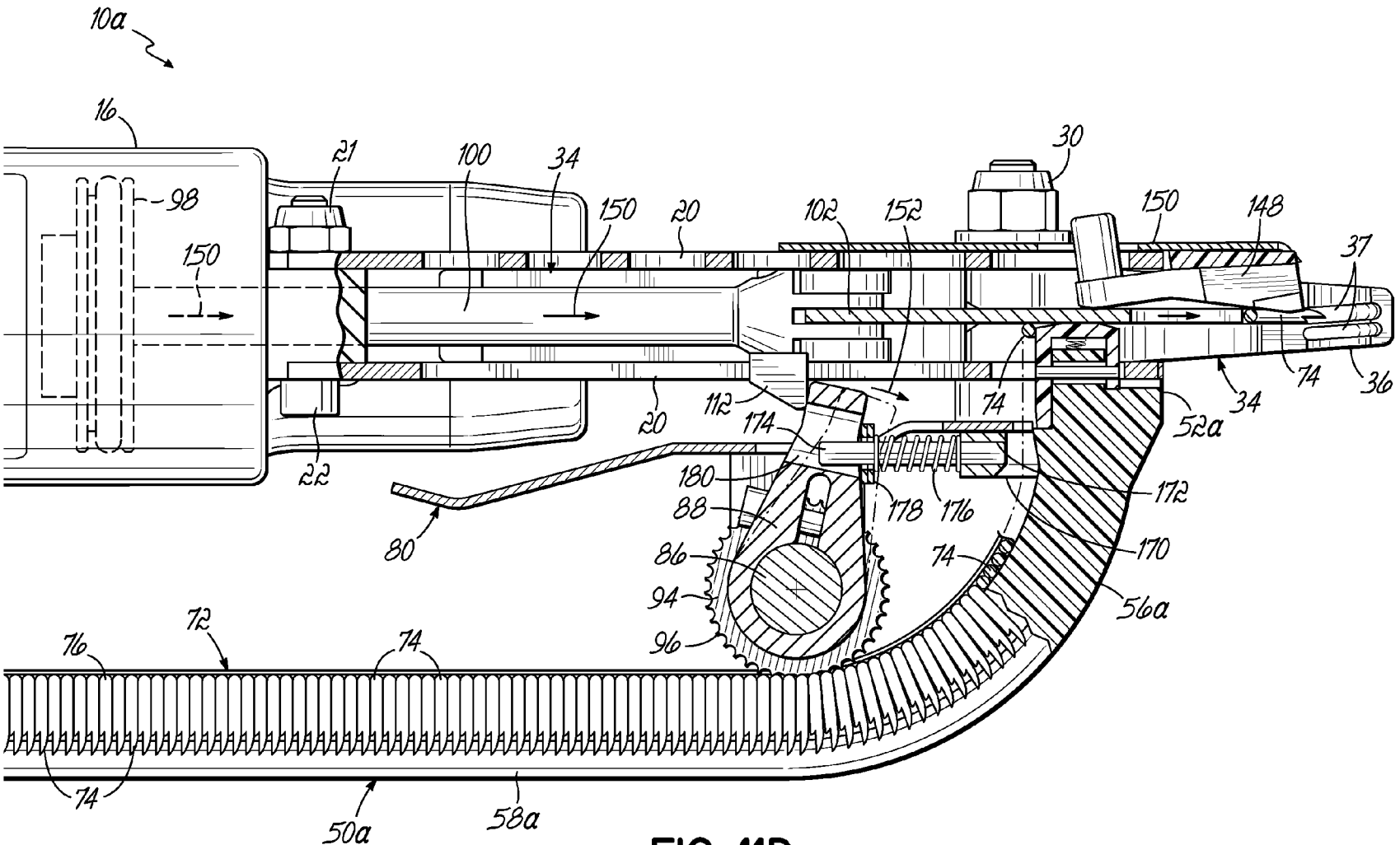
FIG. 11D is a cross-sectional view of a portion of the tool of FIG. 8 showing the piston moving forwardly.

As best seen in FIGS. 9 and 10, clamping tool 10*a* further comprises a generally C-shaped holder 170 which has two openings (not shown) through which the bolts or fasteners 28 extend. As shown in FIGS. 11A-11C, the generally C-shaped holder 170 also has an opening 172 which supports one end of a spring support 174 (the right side as shown in FIG. 10). A compression spring 176 surrounds the spring support 174. The spring support 174 passes through two washers 178. The other end of the spring support 174 is supported by an opening 180 in a clamp 88*a*. Clamp 88*a* is identical to clamp 88 of the first embodiment except it has an opening 180 in the clamp 88*a* which supports one end of the spring support 174.

FIG. 11A illustrates a portion of clamping tool 10*a* partially in cross-section and illustrates the piston 98 in its forward or "at rest" position and the trigger 108 at rest, before being pulled or activated. In this "at rest" position, all the parts of the clamping tool 10*a* are stationary; not until the trigger is pulled do the moving parts move. In this "at rest" position, the pusher 112 attached to the piston rod 100 holds the clamp 88 in a "loaded position" (to the right as seen in FIG. 11A) against the biasing force of the spring 176, which is in a compressed condition urging the clamp 88 to rotate counter-clockwise as viewed in FIG. 11A. The inherent energy of the compressed spring 176 wants to pivot the clamp 88 to the left as shown in FIG. 11A. As shown in FIG. 11A, spring 176 exerts a force on the clamp 88*a*, but does not move the clamp 88*a* due to the presence and location of the pusher 112.

As shown in FIG. 11B, when the trigger 108 is pulled, the piston 98 and piston rod 100 move rearwardly in the direction of arrows 182. The pusher 112, attached to the piston rod 100, moves away from the clamp 88*a* and no longer inhibits movement of the clamp 88*a*. The spring 176 then rotates or pivots the clamp 88*a* in a counter-clockwise direction (when viewed from the top of the tool), as shown by arrow 184. As shown in FIG. 11B, such counter-clockwise movement of the clamp 88*a* (when viewed from the top of the tool) pivots the shaft 86 and the feed rollers 94 in a counter-clockwise direction (when viewed from the top of the tool) shown by arrow 186 due to the operation of the one-way bearings 92. The teeth 96 of the two feed rollers 94 contact the string of C-rings and cause the C-rings to advance or move forwardly one at a time. The forwardmost C-ring is pushed by the feeder blade 102 to a position in which, upon the next pull of the trigger 108, the forwardmost C-ring may be closed.

As shown in FIG. 11C, when the trigger 108 is held rearwardly, the piston 98 and piston rod 100 are in their rearwardmost position. This position corresponds to the position shown in FIG. 6B. With the piston 98, piston rod 100 and pusher 112 all in their rearwardmost position, the spring or biaser 176 is expanded, and the clamp 88*a* in its leftmost position (when viewed from the top of the tool), limited by the slot 90 in the mounting bracket 80, as shown in FIG. 9 or the size of one C-ring. With each pull of the trigger 108 the C-rings 74 move one at a time on the magazine 50*a* towards the jaws.

As shown in FIG. 11C, when the trigger 108 is released, the piston 98 and piston rod 100 move forwardly in the direction of arrow 150. As shown in FIGS. 6A and 6C, when the operator releases the trigger 108, the spring loaded plunger 132 is moved forwardly by the force of spring 136, changing the position of the O-rings 134 as described above with respect to the first embodiment. Movement of the plunger 132 allows air to move piston 98 and the piston rod 100 forwardly in the direction of arrow 150. The pusher 112 attached to the piston rod 100 contacts the clamp 88*a* and pivots or rotates it in a clockwise direction shown by arrow 152 in FIG. 11C (when viewed from the top of the tool). This clockwise pivot or movement of the clamp 88*a* pivots or rotates the clamp 88*a* and shaft 86 without pivoting or moving the feed rollers 94 due to the operation of the one-way bearings. This clockwise pivoting or rotational movement of the clamp 88*a* further loads or energizes the spring 176. Upon the next release or pull of the trigger 108, the process repeats itself.

In the event an operator wishes to remove one or more C-rings 74, including a group 72 of C-rings 74, from any of the magazines disclosed herein, the operator may push the free end of mounting bracket 80, as seen in FIG. 9, towards the side plates 20. Such force moves the mounting bracket 80, along with the shaft 86, one-way bearings 92 and feed rollers 94 such the feed rollers 94 no longer engage or contact the C-rings 74. Without the feed rollers 94 contacting the C-rings 74 on the magazine, one or more C-rings 74 may be removed from the magazine. Removal of one or more C-rings 74 from the magazine may be desirable if tool malfunctions in some way or the C-rings 74 become jammed or fail to move as desired.

While I have described several embodiments of my invention, those persons skilled in the art will readily recognize modifications and changes which may be made without departing from the spirit or scope of the invention. For example, the magazine may be shaped differently or located in a different location than as described or illustrated herein. This invention may be used to apply different fasteners such as D-rings. Accordingly, I intend for my invention to be limited only by the following claims:

I claim:

1. A clamping tool for closing C-rings to create hog rings, the tool comprising:

a body comprising a handle and a pneumatic cylinder;

a piston movable inside the cylinder, the piston being attached to a piston rod extending from the piston towards a front end of the tool;

a movable trigger for activating the piston inside the pneumatic cylinder;

a pair of side plates secured to the body, the piston rod being movable between the side plates;

a pusher attached to the piston rod for engaging and moving a clamp, the clamp being fixedly secured to a shaft, said shaft being secured in position by a mounting bracket secured to one of the side plates;

two movable jaws pivotally mounted to the side plates;

at least one feed roller and at least one one-way clutch bearing, the shaft extending through each of the feed rollers and each of the one-way clutch bearings;

a compression spring surrounding a spring support for biasing the clamp rearwardly towards the body of the device;

a magazine attached to one of the side plates, the magazine being adapted to receive a plurality of C-rings;

a stationary holder secured to a front portion of the magazine and having an opening supporting one end of the spring support, the other end of the spring support being supported by said clamp;

wherein upon the trigger being pulled, the pusher moves rearwardly with the piston rod, the compression spring contacting the clamp and moving the clamp, shaft, one-way clutch bearings and feed rollers in a counter-clockwise direction, when viewed from the top of the tool, the feed rollers contacting the C-rings to advance the C-rings one at a time into a clamping position from the magazine and upon release of the trigger, the pusher contacts the clamp and rotates the clamp in a clockwise direction, when viewed from the top of the tool, to load the compression spring for the next pull of the trigger.

2. The tool of claim 1 wherein the magazine has at least one curved portion.

3. The tool of claim 1 wherein the magazine comprises at least one piece of material.

4. The tool of claim 1 further comprising a bracket secured to opposed sides of the magazine.

5. The tool of claim 1 further comprising a feeder blade secured to one end of the piston rod for feeding C-rings into position to be closed.

6. The tool of claim 1 wherein each of the feed rollers only rotates in one direction because each of the feed rollers is secured to one of the one-way clutch bearings which only rotate in one direction.

7. The tool of claim 1 wherein the piston moves rearwardly to a rearward position at the back of the cylinder when the trigger is pulled.

8. The tool of claim 1 wherein rollers attached to the piston rod cause the jaws to close around a C-ring upon the piston rod moving rearwardly due to the trigger being pulled.

9. The tool of claim 1 wherein the piston moves forwardly to a forward position at the front of the cylinder when the trigger is released.

10. The tool of claim 1 wherein rollers attached to the piston rod cause the jaws to open and a new C-ring inserted into a gap upon the piston rod moving forwardly due to the trigger being released.

11. A clamping tool for closing C-rings to create hog rings, the tool comprising:

a body comprising a handle and a pneumatic cylinder;

a piston movable inside the cylinder;

a piston rod attached to the piston at one end and attached to a feeder blade at the other end;

a movable trigger for activating the piston;

a pair of side plates secured to the body, the piston rod being movable between the side plates;

upper and lower jaws used to close a C-ring, said upper and lower jaws being pivotally secured to the side plates and located between the side plates;

a magazine attached to one of the side plates, the magazine being adapted to receive a plurality of C-rings;

a mounting bracket secured to one of the side plates for rotatably retaining a shaft;

a pusher attached to the piston rod for engaging and moving a clamp, the clamp being fixedly secured to the shaft;

feed rollers and one-way clutch bearings, the shaft extending through the feed rollers and the one-way clutch bearings;

a compression spring surrounding a spring support for biasing the clamp rearwardly towards the body of the device;

a stationary holder secured to the magazine and having an opening supporting one end of the spring support, the other end of the spring support extending through an opening in said clamp, wherein the spring support passes through at least one washer, the at least one washer maintaining the compression spring in a compressed condition between the stationary holder and the clamp until the pusher moves rearwardly;

wherein upon the trigger being pulled, the pusher moves rearwardly with the piston rod away from the clamp, the loaded spring contacting the clamp and moving the clamp, shaft, bearings and feed rollers in a counter-clockwise direction, when viewed from the top of the tool, the feed rollers contacting the C-rings to advance the C-rings one at a time from the magazine into a clamping position between the jaws of the tool and upon release of the trigger, the piston and piston rod with attached pusher move forwardly, the pusher contacting the clamp and pivoting the clamp and shaft in a clockwise direction, when viewed from the top of the tool without rotating the feed rollers or the C-rings.

12. The tool of claim 11 wherein the magazine has at least one curved portion.

13. The tool of claim 11 wherein the magazine is a unitary member.

14. The tool of claim 11 further comprising a bracket secured to opposed sides of the magazine.

15. A clamping tool for closing C-rings to create hog rings, the tool comprising:

a pneumatic cylinder;

a piston movable inside the cylinder;

a piston rod attached to the piston at one end and attached to a feeder blade at the other end;

a pair of side plates secured to the pneumatic cylinder, the piston rod being movable between the side plates;

upper and lower jaws pivotally secured to the side plates;

a magazine attached to one of the side plates, the magazine being adapted to receive a plurality of C-rings;

a mounting bracket secured to one of the side plates;

a shaft rotatably secured to the mounting bracket;

a pusher attached to the piston rod for engaging and moving a clamp, the clamp being fixedly secured to the shaft;

at least one feed roller and at least one one-way clutch bearing, the shaft extending through each of the feed rollers and each of the one-way clutch bearings;

a compression spring surrounding a spring support for biasing the clamp rearwardly towards the body of the device;

a stationary holder supporting one end of the spring support, the other end of the spring support being supported by said clamp, wherein the spring support passes through at least one washer which moves with the clamp by the compression spring when the pusher is moved rearwardly;

a trigger oriented such that upon the trigger being pulled, the pusher moves rearwardly with the piston rod out of contact with the clamp, such that the compression spring moves the shaft and clamp in a counter-clockwise direction, when viewed from the top of the tool, along with rotating the feed rollers in the same direction, the feed rollers contacting the C-rings on the magazine to advance the C-rings one at a time into a clamping position and upon release of the trigger, the pusher moves forwardly into contact with the clamp, rotating the clamp and shaft in a clockwise direction, when viewed from the top of the tool, without rotating the bearings or feed rollers.

16. The tool of claim 15 further comprising a handle having an air inlet port and an exhaust port for moving the piston inside the cylinder.

17. The tool of claim 15 wherein the piston rod is located between the side plates.

18. The tool of claim 15 wherein the tool has multiple washers mounted on the spring support.

19. The tool of claim 15 wherein the magazine has at least one curved portion.

20. The tool of claim 15 further comprising a bracket attached to the magazine.

* * * * *